United States Patent [19]

Lachiw et al.

[11] Patent Number: 4,589,228

[45] Date of Patent: May 20, 1986

[54] HINGED DOOR FOR TV CONTROL PANEL

[75] Inventors: Ark Lachiw, Park Ridge; Illia M. Stevanovich, Mt. Prospect, both of Ill.

[73] Assignee: Zenith Electronics Corporation, Glenview, Ill.

[21] Appl. No.: 732,128

[22] Filed: May 8, 1985

[51] Int. Cl.[4] ..... E05F 1/10

[52] U.S. Cl. ..... 49/386; 220/337; 220/338

[58] Field of Search ..... 49/386, 398; 220/337, 220/338

[56] References Cited

U.S. PATENT DOCUMENTS

| | | | |
|---|---|---|---|
| 2,149,586 | 3/1939 | De Boer | 220/337 |
| 2,614,021 | 10/1952 | Giffard | 49/386 |
| 3,432,967 | 3/1969 | Simon | 49/386 |
| 3,978,616 | 9/1976 | Pennock | 49/386 |
| 4,115,901 | 9/1978 | Schmidt | 49/386 X |

*Primary Examiner*—Philip C. Kannan

[57] ABSTRACT

A door is pivotally mounted to a support panel by means of right and left outwardly directed mounting studs positioned on the support panel which are adapted for insertion within a respective aperture in a lateral portion of the door. The door is free to pivot about the mounting studs in a vertical direction and includes a pair of tabs extending from a lower portion of the door toward the panel. Each tab is aligned with a respective resilient biasing arm extending from the panel toward the door. Each door tab is engaged by a respective biasing arm when the door is moved toward the closed position so as to urge the door to the full closed position in which it is maintained by the biasing arms. When the door is opened by rotating it about an axis aligned with the mounting studs, the tabs are displaced from engagement with the biasing arms and the door is free to assume the full open position wherein it is maintained in a generally horizontal orientation by rotations stops. Each resilient biasing arm includes a forward cam surface for abutting an end portion of a respective tab in maintaining the door in a generally vertical closed position.

14 Claims, 9 Drawing Figures

FIG. 5
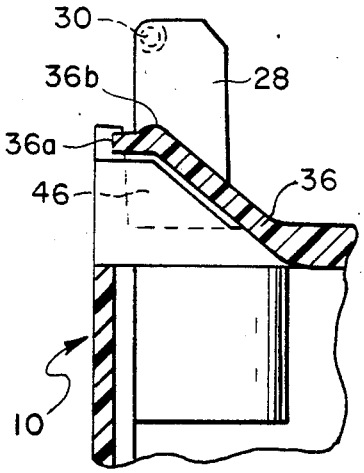
FIG. 6
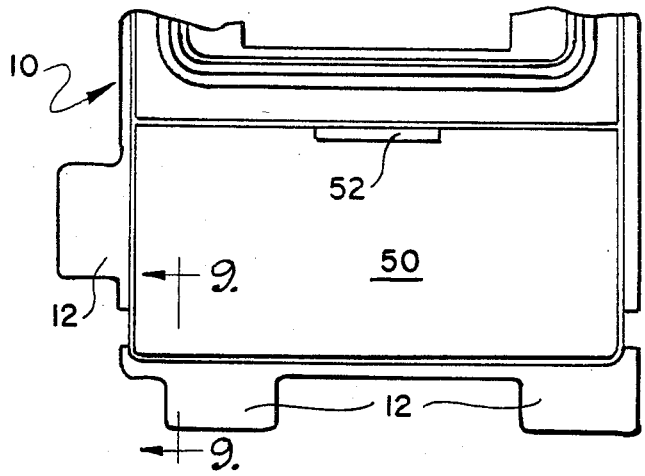
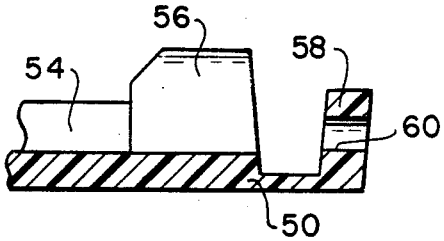
FIG. 8
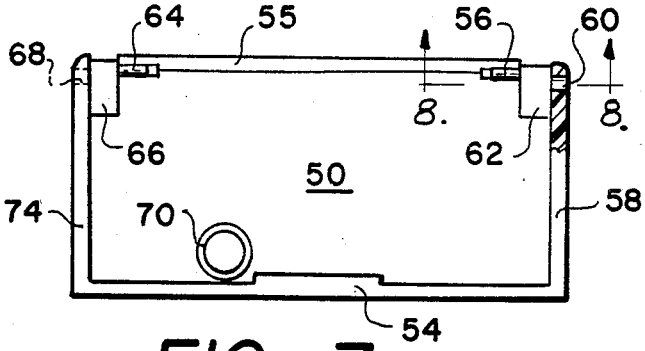
FIG. 7
FIG. 9
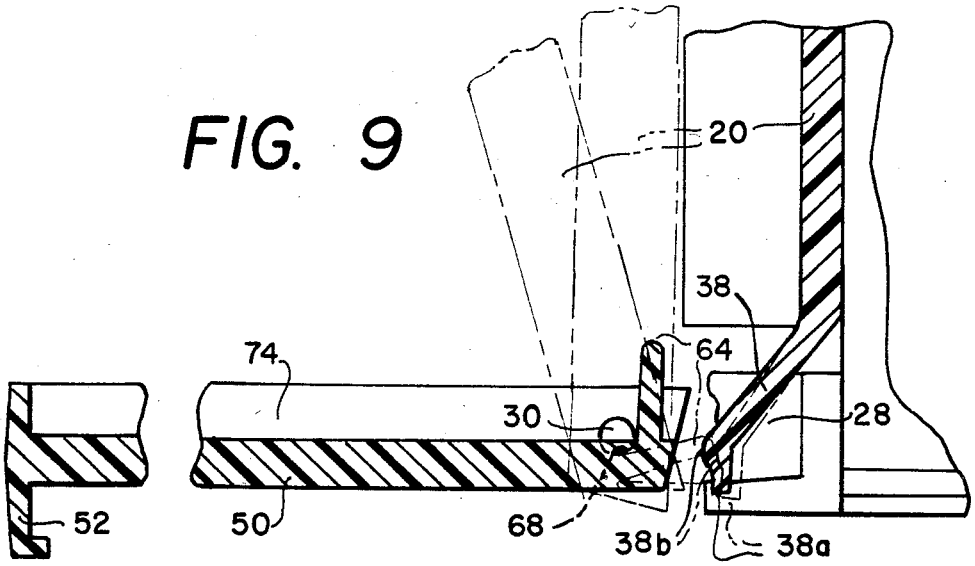

HINGED DOOR FOR TV CONTROL PANEL

BACKGROUND OF THE INVENTION

This invention relates generally to pivoting door arrangements and is particularly directed to a hinged door wherein the hinge mechanism is integrated with the door and its supporting structure.

Pivoting doors are frequently used in electronic apparatus to cover a control panel. This is particularly the case in consumer-type electronic products where the controls are frequently positioned behind a movable door in order to limit access to the controls as well as to improve the aesthetics of the electronic apparatus. Where the door is of the pivoting type, certain design and operating criteria are particularly desirable. For example, the door should be easily installed and inexpensively manufactured. Its pivotal mounting configuration should involve a minimal number of components all of which should be low in cost and of simple design. Thus, the use of springs, magnets or latches, as frequently encountered in the prior art, is highly undesirable from the standpoint of increased complexity and expense as well as reduced reliability. In addition, a separate hinge mechanism is undesirable since this too involves an additional component, or components, with the hinge itself requiring a separate installation procedure. The pivoting door in combination with its mounting arrangement should also be easily manipulated, structurally strong, and not easily broken. Finally, the door mounting arrangement should be capable of maintaining the door in both the full open and full closed positions in a stable manner and should provide for the self-closure of the door when it is oriented in an intermediate position.

The present invention provides a hinged door arrangement particularly adapted for a television control panel which possesses all of the aforementioned characteristics and is comprised of just two components—a pivoting door and a support panel to which it is easily, yet securely mounted.

OBJECTS OF THE INVENTION

Accordingly, it is an object of the present invention to provide a hinged door particularly adapted for use in electronic control panels.

It is another object of the present invention to provide a hinged door arrangement wherein the hinge mechanism is integral with the door and its supporting structure.

Yet another object of the present invention is to provide a hinged door arrangement which is comprised of only two elements—the door and its supporting structure.

A further object of the present invention is to provide a hinged door construction without springs, magnets, latches, or a separate hinge mechanism.

A still further object of the present invention is to provide a pivoting door arrangement which biases the door to the closed position while allowing it to be easily opened and remain stably in the full open position.

Another object of the present invention is to provide a low cost hinged door arrangement having a minimum number components which is reliable, easily fabricated and easily assembled.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 5 is a sectional view of the portion of the control panel illustrated in FIG. 3 taken along sight line 5—5 therein;

FIG. 6 is a partial front view of a control panel with a door attached thereto in accordance with the present invention;

FIG. 7 a plan view of a door capable of being pivotally mounted to the control panel of FIGS. 1 and 2 in accordance with the principles of the present invention;

FIG. 8 is a sectional view of a portion of the door illustrated in FIG. 7 taken along sight line 8—8 therein; and FIG. 9 is a lateral section view of a door pivotally mounted to and supported by a panel as shown in FIG. 6 illustrating the door in several different orientations taken along sight line 9—9 therein.

DESCRIPTION OF THE PREFERRED EMBODIMENT

Figure 1:
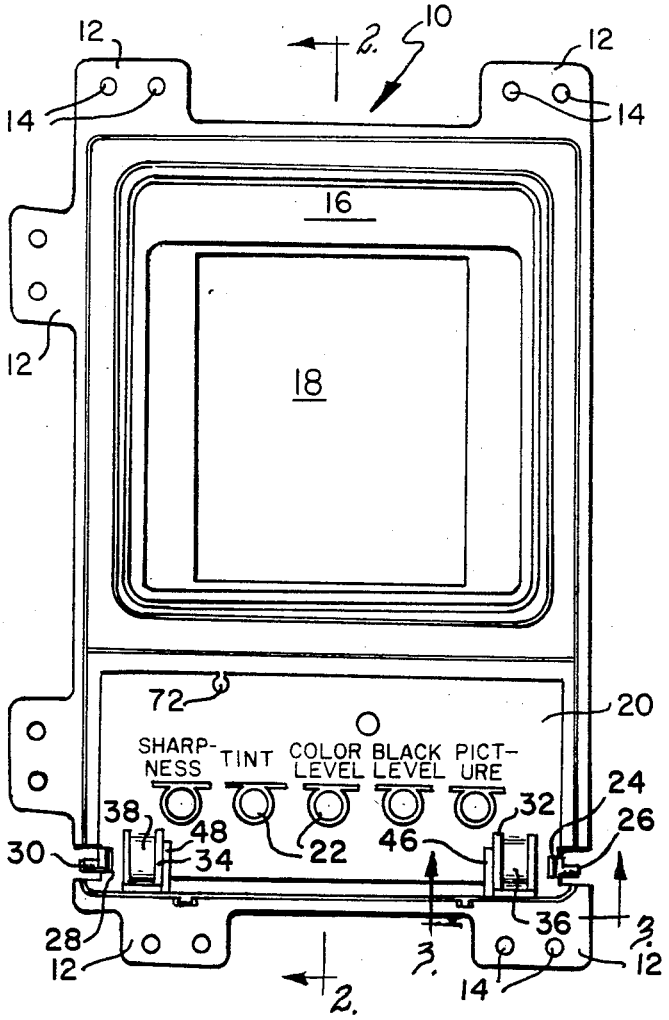
FIG. 1 is a front view of a control panel to which a pivoting door may be mounted in accordance with the present invention.
Figure 2:
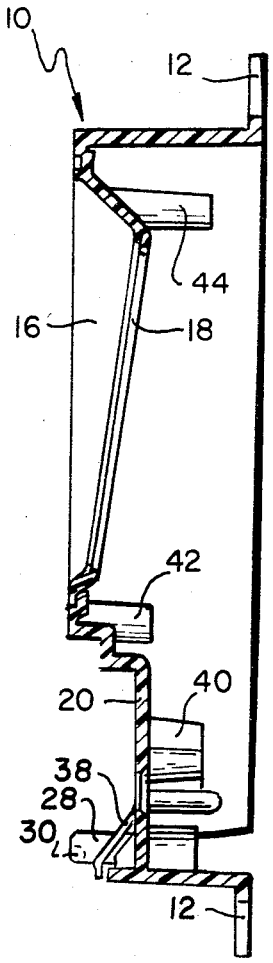
FIG. 2 is a sectional view of the control panel of FIG. 1 without the door attached thereto taken along sight line 2—2 in FIG. 1.

Referring to FIG. 1, there is shown a front view of a control panel 10 to which a door may be pivotally coupled in accordance with the principles of the present invention. FIG. 2 is a sectional view of the control panel 10 of FIG. 1 taken along sight line 2—2 therein.

The control panel 10 is preferably a unitary structure comprised of a high strength, molded plastic. The control panel 10 includes a plurality of mounting tabs 12 positioned around the periphery thereof. Each mounting tab includes one or more apertures 14 through which a coupling pin, such as a threaded screw, may be inserted for securely mounting the control panel 10 on a support structure such as the cabinet of a consumer-type electronic apparatus, e.g., a television receiver. When thus positioned upon an appropriate supporting structure, the portion of the control panel 10 shown in FIG. 1 would be directed outwardly from the apparatus. Thus, in referring to FIG. 2, the outer portion of the control panel 10 as used herein is on the left of the figure, while the inner portion of the control panel is toward the right. In addition, in referring to right and left hand portions of the control panel as well as of the door (not shown in FIGS. 1 or 2), such designations are taken with the control panel viewed from the rear or as viewed when looking outward from the apparatus to which it is mounted.

The control panel 10 includes an upper, recessed portion 16 within which is located a generally rectangular aperture 18. The aperture 18 within the control panel 10 is adapted to receive a keyboard panel (not shown) having a plurality of keys by means of which user entries such as channel selection may be made.

The control panel 10 also includes a generally flat, lower recessed portion 20 which may include a plurality of control knob apertures 22 adapted to receive a respective rotary control knob (not shown). These controls permit a user to provide additional control inputs to the television receiver as indicated in the figure. Referring specifically to FIG. 2, extending from a rear portion of the control panel 10 are a plurality of mounting brackets 40, 42 and 44, each typically including a threaded aperture therein. Mounting brackets 42 and 44 may be used for securely positioning a channel select keyboard (not shown) within the rectangular aperture 18 in the upper recessed portion 16 of the control panel 10. Similarly, a mounting bracket, or brackets, 40 positioned immediately aft of the lower recessed portion 20 of the control panel 10 may be used for mounting a control module (not shown) from which extend various rotary control knobs which may each be positioned within a respective control knob aperture 22. These control modules may be maintained in position upon respective mounting bracket by conventional means such as a threaded screw. The control panel 10 as thus far described is generally conventional in construction and configuration, with the various features of the present invention described in detail in the following paragraphs.

Positioned on lower, lateral portions of the control panel 10 and extending forwardly therefrom are left and right mounting arms 24, 28. Each of the left and right mounting arms 24, 28 includes a respective mounting stud 26, 30 positioned adjacent its distal end and extending outwardly from an outer, lateral portion thereof. Each of the left and right mounting arms 24, 28 is provided with a certain degree of flexibility and resilience to facilitate the positioning of a door (not shown) thereon as described in detail below.

Also positioned on a lower portion of the control panel 10 in the lower recessed portion 20 thereof are left and right apertures 32, 34. The left and right apertures 32, 34 are respectively positioned immediately adjacent to and inwardly toward the center of the control panel 10 from the left and right mounting arms 24, 28. Positioned over a respective left and right aperture 32, 34 and securely coupled to the lower recessed portion 20 of the control panel 10 are left and right resilient biasing arms 36, 38. The left and right resilient biasing arms 36, 38 are securely coupled at the upper, proximal ends thereof to the control panel 10 and extend forwardly and downwardly from the control panel's lower recessed portion 20. Each of the left and right resilient biasing arms 36, 38 is comprised of a flexible, resilient material which allows the biasing arm to be deflected toward a respective aperture immediately to the rear thereof by force applied thereto and to resume its initial, forward position when the applied force is removed. Each of the left and right resilient biasing arms 36, 38 engages a portion of the door (not shown) for urging it to a closed position as described in detail below. In a preferred embodiment, the control panel 10 as well as the left and right mounting arms and studs and left and right resilient biasing arms 36, 38 are formed of a unitary structure such as a high strength molded plastic.

Figure 3:
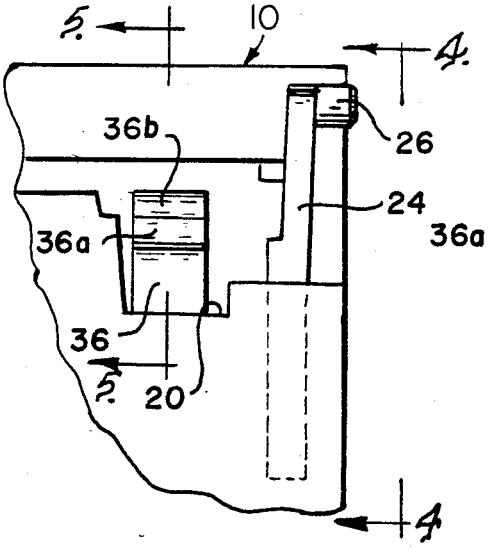
FIG. 3 is a sectional view of a portion of the control panel shown in FIG. 1 taken sight line 3—3 therein.
Figure 4:
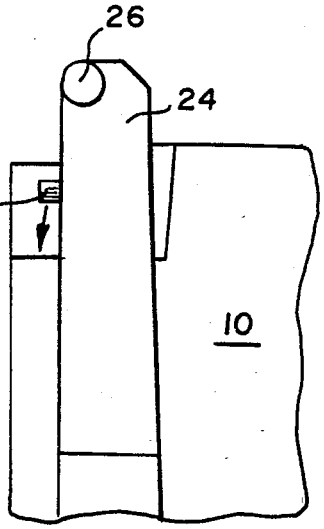
FIG. 4 is a side view of the portion of the control panel illustrated in FIG. 3 taken along sight line 4—4 therein.

Referring to FIG. 3, there is shown a sectional view of a portion of the control panel 10 of FIG. 1 taken along sight line 3—3 therein. A lateral view of the sectional view of a portion of the control panel 10 of FIG. 3 is shown in FIG. 4. As shown in FIGS. 3 and 4, the left mounting arm 24 includes a generally cylindrical-shaped mounting stud 26 extending outwardly from a lateral portion thereof adjacent to its distal end. As stated above, the left mounting arm 24 is preferably comprised of a flexibly resilient material allowing the mounting arm to be deflected inwardly, or to the left as shown in FIG. 3, as indicated by the arrow therein. This facilitates the positioning of a lateral portion of the door (not shown) on the mounting arm by inserting the mounting stud 26 in an aperture within the door as described in detail below. Also as stated above, the left resilient biasing arm 36 is coupled to and extends from the lower recessed portion 20 of the control panel 10. The left resilient biasing arm 36 extends downwardly as well as outwardly from the lower recessed portion 20 of the control panel and includes a lower distal end **36*a* as well as a forward projection 36*b* on a front surface thereof. The left resilient biasing arm 36 is also comprised of a flexibly resilient material allowing the biasing arm to be deflected rearwardly by a force applied thereto and to resume its initial position following removal of the applied force. The direction of deflection of the left resilient biasing arm 36 is indicated by the arrow in FIG. 4. It is to be noted that this description of the structure and operation of the left mounting arm 24 and the left resilient biasing arm 36 applies equally well to the right mounting arm 28 and the right resilient biasing arm 38**.

Additional details of the mounting arms and resilient biasing arms are shown in FIG. 5 which is a sectional view taken along sight line 5—5 in FIG. 3 through the left resilient biasing arm 36 in a direction toward the right mounting arm 28. Positioned immediately adjacent to the left aperture 32 and the left resilient biasing arm 36 is a left reinforcing rib 46. A similar arrangement is provided on the right-hand portion of the control panel 10 where right reinforcing rib 48 is positioned immediately adjacent to the right aperture 34 and the right resilient biasing arm 38 and toward the center of the control panel. Each of the left and right reinforcing ribs 46, 48 extends forwardly of the lower recessed portion 20 of the control panel and is generally triangular in shape.

Referring to FIG. 6, there is shown a door 50 positioned upon the control panel 10 so as to cover the lower recessed portion thereof in accordance with the present invention. An outer, upper portion of the door 50 is provided with gripping means, or a handle, 52 by means of which the door may be grasped and pivotally displaced as described below.

Referring to FIG. 7, there is shown the inner portion of the door 50. As shown in FIG. 7 the door 50 is oriented such that the upper portion of the door when it is in the closed position is shown in the lower portion of the figure and the lower portion of the door, when closed, is shown in the upper portion of the figure. The inner, upper portion of the door 50 includes an upper rib 54 which extends the length of the door and to which the handle 52 is securely connected. The upper rib 54 facilitates the positioning of the handle 52 on the door 50 and reinforces its mounting thereon. Lateral portions of the door are defined by left and right ribs 58, 74 which extend from the inner surface of the door. Located in lower portions of the left and right ribs 58, 74 are respective left and right mounting apertures 60, 68.

Located immediately inwardly of the apertures 60, 68 in the respective lateral ribs of the door are left and right recessed portions 62, 66 on the inner surface of the door. Extending between the left and right recessed portions 62, 66 and along the lower edge of the door 50 is a lower rib 55. Extending outward from the lower rib 55 adjacent respective ends thereof are left and right tabs 56, 64. Additional details of the configuration of the lower, left-hand portion of the door 50 can be seen in the sectional view of FIG. 8 taken along sight line 8—8 in FIG. 7.

There is provided on the inner surface of the door 50 a door stop 70 which is positioned upon the door so as to be aligned with and to contact a striker tab 72 on the panel's lower recessed portion 20 when the door is closed. The door stop 70 is preferably comprised of a soft, resilient material in order to eliminate noise arising from the closure of the door with an inner portion of the door contacting a forward portion of the support panel.

The assembly and operation of the hinged door of the present invention will now be described in detail in terms of the figures discussed above as well as FIG. 9 which shows the door in the fully opened, fully closed, and intermediate positions. In FIG. 9, a sectional view of the door 50 in the fully open position is shown in solid lines wherein the door is oriented generally horizontally. In this position, the tabs of the door are oriented generally vertically as shown for the case of the right tab 64 in the figure. The door 50 is attached to the control panel 10 by inserting one of the mounting studs on a mounting arm of the control panel into a mounting aperture in a corresponding lateral rib of the door. The other mounting arm is then displaced inwardly toward the center of the control panel in order to permit its mounting stud to be inserted into the other mounting aperture in the opposite, facing lateral rib of the door. Thus, in order to facilitate installation and removal of the door 50 from the control panel 10 each of the left and right mounting arms 24, 28 is preferably comprised of a resiliently flexible material. With each of the mounting studs of the control panel inserted within a respective mounting aperture of the door, the door may be pivotally displaced about an axis defined by the mounting studs 26, 30. With the door 50 oriented in the full open position as shown in solid lines in FIG. 9, counterclockwise rotation of the door is prevented by engagement of the lower, inner surface of the door defined by the left and right recessed portions 62, 66 thereof with respective lower, distal portions of the left and right mounting arms 24, 28. The left and right recessed portions 62, 66 of the door 50 further provide clearance for the respective distal ends of the left and right mounting arms 24, 28 to permit the door to be rotated about the aforementioned axis located adjacent the distal ends of the mounting arm and defined by the aforementioned mounting studs without the inner surface of the door contacting the distal ends of these mounting arms.

As the door 50 is rotated in a clockwise direction about an axis defined by the mounting stud 30 as shown in FIG. 9, the tabs extending from the inner surface of the door engage a respective forward projection of a resilient biasing arm. This is shown in FIG. 9 for the case of the right tab 64 and the forward projection **36*b* of the right resilient biasing arm 38. In this position, the door 50 is oriented at an inclined angle between the full open and full closed positions. If at this point the door is let go, it will fall under the influence of gravity and return to the full open position. However, if the door 50 is further displaced toward the closed position, the distal end of the right tab 64 will further engage the forward projection 36*b* of the right resilient biasing arm 38 deflecting the biasing arm rearward as shown in dotted line form in the figure. When the distal end of the right tab 64 travels beyond the forwardmost point of the forward projection 36*b* on the right resilient biasing arm 38, the resilience of the biasing arm urges it forward so as to bias the right tab 64 downward and urge the door 50 in a clockwise direction of rotation. With the door in a generally vertical orientation and in the fully closed position, the distal end of the right tab 64 is positioned beneath the forward projection 36*b* on the right resilient biasing arm 38 which maintains the tab in this position and the door in the closed configuration. By pulling an upper portion of the door 50 away from the control panel 10, the distal end of the right tab 64 will displace the right resilient biasing arm 38 rearward allowing the door to be opened. By providing the forward projection 36*b* of the right resilient biasing arm 38 with a smooth surface, the door 50 may be opened and closed in a smooth, continuous movement. While the present invention has been described with regard to FIG. 9 in terms of the operation and interaction of the right tab 64 and the right resilient biasing arm 38, this description applies equally well to the interaction and operation of the left tab 56 and the left resilient biasing arm 36**.

There has thus been shown a hinged door arrangement which is comprised of only two elements, i.e., a door and a support panel. The door and the support panel are directly coupled in a pivoting manner to allow the door to be easily positioned in a fully open or a fully closed position and to be biased closed when in an intermediate position. The door and the support panel combination are particularly adapted for use in a control panel of an electronic device and are each preferably comprised of a single piece of molded, high strength plastic. The door is easily installed on and removed from the support panel and the pivoting coupling therebetween does not involve the use of springs, magnets, latches, or a separate hinge mechanism.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An arrangement for pivotally coupling a door to a support panel comprising:

a pair of spaced mounting arms coupled to and extending from the support panel, each mounting arm including a respective mounting stud positioned along the length thereof and extending therefrom;

means defining a pair of spaced apertures in the door for receiving a respective mounting stud in pivotally coupling the door to the support panel;

tab means integral with and extending from the door; and resilient cam means coupled to the support panel for engaging said tab means when the door is in a partially closed position for urging the door to and maintaining the door in a fully closed position, wherein said tab means and said resilient cam means are disengaged when the door is in a fully open position.

2. The arrangement of claim 1 wherein said tab means includes at least one elongated tab extending from an inner portion of the door, wherein said resilient cam means engages a distal end of said at least one elongated tab in urging the door to and maintaining the door in a fully closed position.

3. The arrangement of claim 2 wherein said resilient cam means includes at least one resilient arm having proximal and distal ends and a cam portion positioned between said proximal and distal ends for engaging the distal end of said at least one elongated tab.

4. The arrangment of claim 3 wherein said at least one resilient arm extends from the support panel and the cam portion of said at least one resilient arm is positioned adjacent to the distal end thereof.

5. The arrangment of claim 1 wherein said mounting arms are flexibly resilient to facilitate mounting the door to and removing the door from the support panel.

6. The arrangment of claim 1 wherein the door and said tab means are comprised of a single piece of molded plastic.

7. The arrangement of claim 1 wherein the support panel, said mounting arms and mounting studs, and said resilient cam means are comprised of a single piece of molded plastic.

8. The arrangment of claim 1 wherein said tab means includes a pair of spaced tabs positioned on the door and said resilient cam means includes a pair of spaced, resilient arms positioned on the support panel, wherein each of said resilient arms is aligned with a respective tab means for the mutal engagement thereof when the door is in the partially or fully closed positions.

9. The arrangment of claim 8 wherein an intermediate portion of each of said resilient arms includes a cam surface for engaging a distal end of a respective tab when the door is in a partially closed position for urging the door to a fully closed position.

10. The arrangement of claim 1 wherein the door includes gripping means on an outer portion thereof for facilitating the engagement and pivoting displacement of the door.

11. The arrangement of claim 1 wherein the door is rotated approximately 90° between the fully closed and fully opened positions and wherein said tab means are oriented generally at a right angle to the door.

12. The arrangement of claim 1 wherein the support panel comprises an electronic control panel.

13. The arrangement of claim 1 further including absorbing means for reducing the contact between the door and the support panel when the door is urged to the fully closed position.

14. The arrangement of claim 13 wherein said absorbing means includes a resilient door stop positioned upon an inner surface of the door and a striker tab positioned upon the support panel and aligned with said resilient door stop.

* * * * *